US007757404B2

(12) United States Patent
Ouchi et al.

(10) Patent No.: US 7,757,404 B2
(45) Date of Patent: Jul. 20, 2010

(54) PERSONAL TRIMMING SYSTEM

(75) Inventors: Kazuyuki Ouchi, Hikone (JP); Hidekazu Sueyoshi, Kanzakigun (JP); Toshihiro Takeuchi, Hikone (JP); Kenichi Muraki, Hikone (JP); Keiko Funatsu, Hikone (JP)

(73) Assignee: Panasonic Electric Works Co., Ltd., Kadoma-Shi, Osaka (JP)

( * ) Notice: Subject to any disclaimer, the term of this patent is extended or adjusted under 35 U.S.C. 154(b) by 0 days.

(21) Appl. No.: 12/511,730

(22) Filed: Jul. 29, 2009

(65) Prior Publication Data

US 2009/0288298 A1 Nov. 26, 2009

Related U.S. Application Data

(62) Division of application No. 11/133,373, filed on May 20, 2005.

(30) Foreign Application Priority Data

May 27, 2004 (JP) ..... 2004-158272

(51) Int. Cl.
*B26B 19/02* (2006.01)

(52) U.S. Cl. ..... 30/43.91; 30/216; 30/244

(58) Field of Classification Search ..... 30/29.5, 30/42, 43, 43.91, 53, 208–210, 216, 241, 30/247, 211, 244; 403/61
See application file for complete search history.

(56) References Cited

U.S. PATENT DOCUMENTS

| | | | | |
|---|---|---|---|---|
| 1,481,168 | A | | 1/1924 | Wilson |
| 1,759,842 | A | | 5/1930 | Fossa |
| 1,760,712 | A | | 5/1930 | Morimoto |
| 1,832,289 | A | | 11/1931 | Fewins |
| 2,067,075 | A | | 1/1937 | Clark |
| 2,275,180 | A | | 3/1942 | Holsclaw |
| 2,827,695 | A | | 3/1958 | Vitale |
| 3,365,963 | A | | 1/1968 | Happe |
| 4,651,420 | A | | 3/1987 | Lonnecker |
| 4,651,761 | A | | 3/1987 | Suen et al. |
| 4,868,988 | A | | 9/1989 | Han |
| 5,165,172 | A | | 11/1992 | Weinrauch |
| 5,261,162 | A | * | 11/1993 | Siegler ..... 30/216 |
| 6,098,288 | A | | 8/2000 | Miyagawa et al. |
| 6,098,289 | A | | 8/2000 | Wetzel et al. |
| 6,141,878 | A | | 11/2000 | Eslambolchi et al. |
| 6,301,786 | B1 | | 10/2001 | Oswald et al. |
| 6,735,873 | B2 | | 5/2004 | Langhans et al. |
| 2003/0217468 | A1 | | 11/2003 | Izumi et al. |
| 2006/0053632 | A1 | | 3/2006 | Khubani |

FOREIGN PATENT DOCUMENTS

| | | |
|---|---|---|
| JP | 49-79472 | 7/1974 |

(Continued)

*Primary Examiner*—Boyer D. Ashley
*Assistant Examiner*—Edward Landrum
(74) *Attorney, Agent, or Firm*—Bacon & Thomas, PLLC

(57) ABSTRACT

A personal trimming system includes a main body having a motor and a part of a driving unit for converting a rotation of the motor into a reciprocating motion; and a head portion having a driven member moving in a reciprocating motion. The head portion is pivotably supported with respect to the main body, and a gap is provided between the main body and the head portion.

5 Claims, 14 Drawing Sheets

FOREIGN PATENT DOCUMENTS

| | | | |
|---|---|---|---|
| JP | 49000199 | | 7/1974 |
| JP | 56-70784 | * | 6/1981 |
| JP | 56-148375 | | 11/1981 |
| JP | 57-31886 | | 2/1982 |
| JP | 08-336682 | | 12/1996 |
| JP | 2003-117268 | | 4/2003 |

* cited by examiner

PERSONAL TRIMMING SYSTEM

CROSS-REFERENCE TO RELATED APPLICATIONS

This application is a divisional of pending U.S. application Ser. No. 11/133,373, filed on May 20, 2005, which claims priority to Japanese Patent Application NO. 2004-158272 filed on May 27, 2004.

FIELD OF THE INVENTION

The present invention relates to a personal trimming system having a driven member, e.g., a trimmer blade, moving in a reciprocating motion; and, more particularly, to a personal trimming system in which a head portion accommodating therein a driven member moving in a reciprocating motion is capable of pivoting with respect to a main body.

BACKGROUND OF THE INVENTION

As shown in, e.g., Japanese Patent Laid-open Application No. S56-70784, as for a personal trimming system (a hair clipper), a device in which a head portion pivots with respect to a hand-holdable portion (main body) has been known. FIG. 13 shows a configuration of a conventional hair clipper 100. Referring to FIG. 13, the conventional hair clipper 100 includes an approximately cylindrical hand-holdable portion 110 and a head portion 120 pivotably supported at an upper vicinity of the hand-holdable portion 110.

Provided inside the hand-holdable portion 110 are a motor 111, a driving unit 130 for converting a rotation of a shaft of the motor 111 into a reciprocating motion and a battery 112. The driving unit 130 includes a pinion gear 131 secured to the shaft of the motor 111; a face gear 132 pivoting with respect to a shaft (not shown) provided in a direction perpendicular to the shaft of the motor 111 while being engaged with the pinion gear 131; and a driving connecting piece 133 provided with an opening 133A rotatably insertion-fitted to an eccentric boss 132A provided at the face gear 132. A trimmer blade (not illustrated) is connected to the driving connecting piece 133 and, further, downwardly installed in a direction perpendicular with respect to the page in FIG. 13.

Provided at the upper vicinity of the hand-holdable portion 110 is a spherical shaft 134 having an approximately spherical outer peripheral surface. Further, provided at a lower portion of the head portion 120 is an approximately spherical shaped bearing 121 insertion-fitted to the approximately spherical outer peripheral surface of the spherical shaft 134. In other words, the spherical shaft 134 and the approximately spherical shaped bearing 121 form a spherical shaped bearing, and the head portion 120 is pivotably supported with respect to the hand-holdable portion 110. The face gear 132 is provided at an inner portion of the spherical shaft 134 and, further, a pivoting point (rotational shaft) of the head portion 120 and a rotational shaft of the face gear 132 are provided so that they are coaxial.

In the conventional hair clipper 100, the size of the upper vicinity of the hand-holdable portion 110 is about the size of the lower vicinity of the head portion 120 and, further, the exterior of the hair clipper 100 has been designed primarily for aesthetic consideration. Therefore, it is difficult for a user to know where the head portion 120 pivots. In such case, if the user grips a boundary portion between the hand-holdable portion 110 and the head portion 120, the head portion 120 cannot adequately pivot with respect to the hand-holdable portion 110, thereby conforming improperly to irregularities of the skin. Such a problem occurs in a general personal trimming system such as an electric shaver, an electric toothbrush or the like as well as a hair clipper.

SUMMARY OF THE INVENTION

It is, therefore, an object of the present invention to provide a personal trimming system having a conspicuous point where a head portion pivots with respect to a main body to thereby reduce the possibility of a user's hand reaching into a boundary portion between the head portion and the main body.

In accordance with the present invention, there is provided a personal trimming system including: a main body having a motor and a part of a driving unit for converting a rotation of the motor into a reciprocating motion; and a head portion having a driven member moving in a reciprocating motion, wherein the head portion is pivotably supported with respect to the main body, and a gap is provided between the main body and the head portion.

BRIEF DESCRIPTION OF THE DRAWINGS

The above and other objects and features of the present invention will become apparent from the following description of preferred embodiments, given in conjunction with the accompanying drawings, in which:

FIGS. 9A and 9B depict a mechanism for restricting a pivotable range of the head portion with respect to the hand-holdable portion in the hair clipper, wherein FIGS. 9A and 9B show a basic state where the head portion is not pivoted and a state where the head portion is pivoted to its maximum allowable angle, respectively;

DETAILED DESCRIPTION OF THE PREFERRED EMBODIMENTS

Figure 1A:
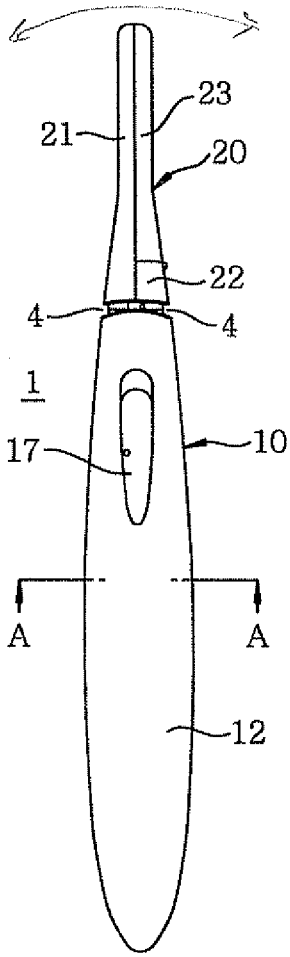
FIGS. 1A to 1C show a configuration of a hair clipper, i.e., an exemplary personal trimming system, in which a head portion accommodating therein a driven member moving in a reciprocating motion can pivot with respect to a main body, in accordance with a preferred embodiment of the present invention, wherein FIGS. 1A, 1B and 1C provide a front view, a side view and a cross-sectional view taken along line A-A, respectively.
Figure 1B:
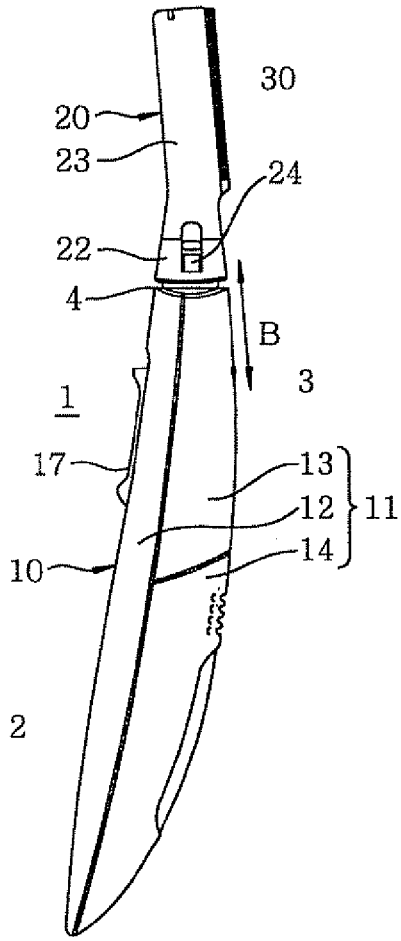
Figure 1C:
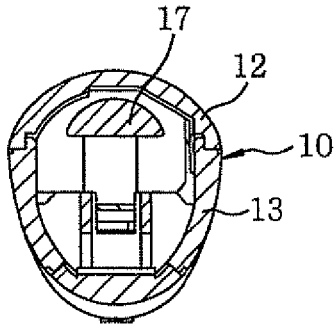
Figure 2:
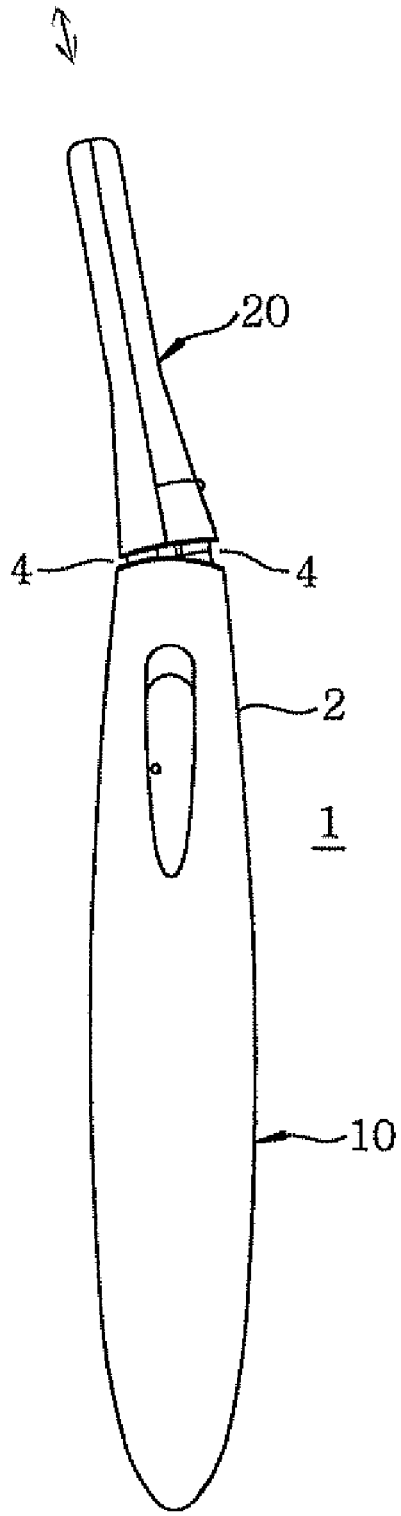
FIG. 2 describes a front view of the hair clipper in a state where a head portion pivots with respect to a hand-holdable portion.
Figure 3:
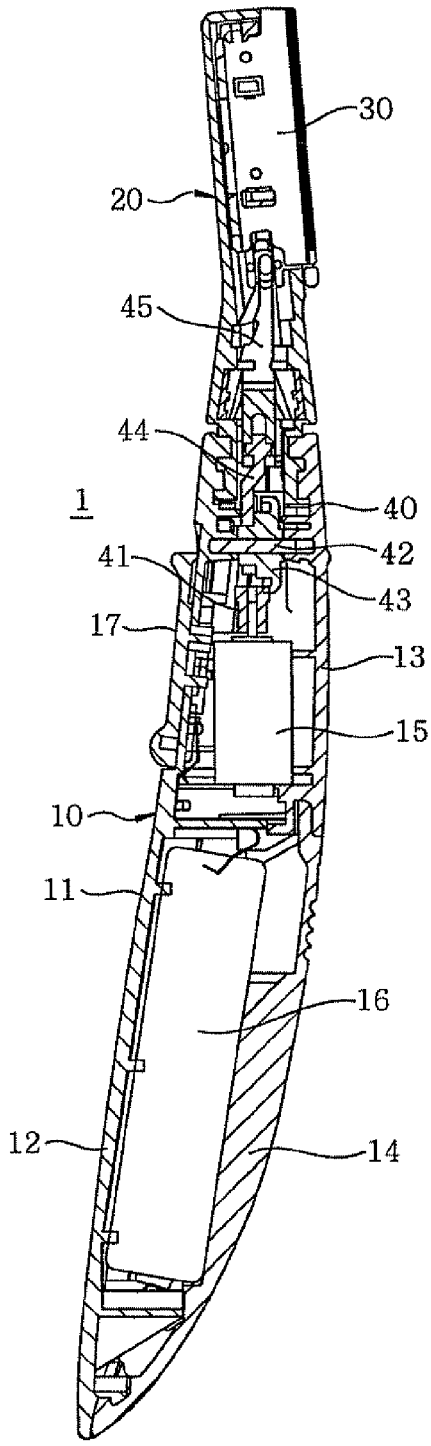
FIG. 3 provides a sectional side view depicting the complete configuration of the hair clipper.
Figure 4:
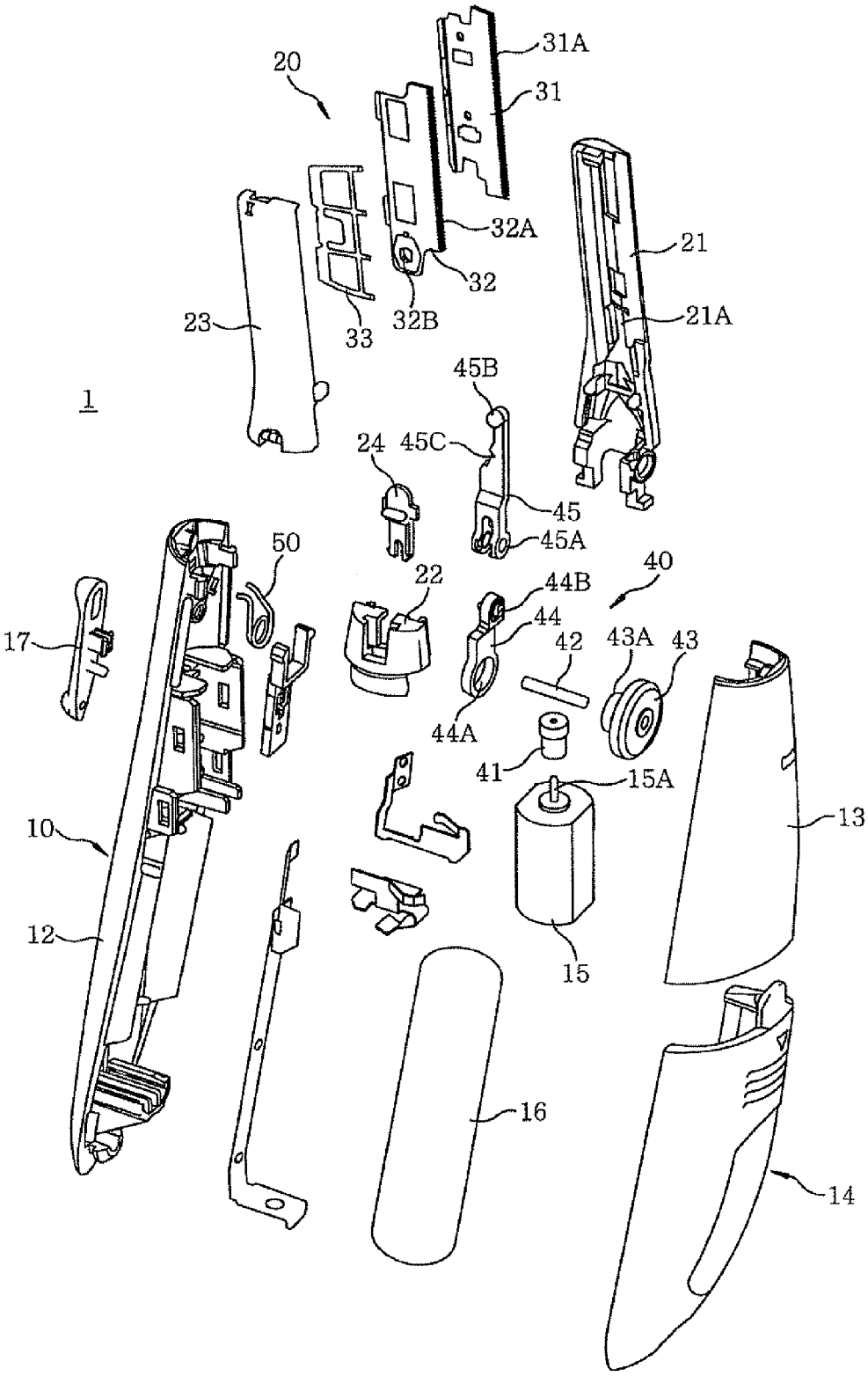
FIG. 4 presents an exploded perspective view illustrating the entire configuration of the hair clipper.

Hereinafter, a personal trimming system, in which a head portion provided with a driven member moving in a reciprocating motion can pivot with respect to a main body, in accordance with preferred embodiments of the present invention will be described. In this embodiment, as for such system, a hair clipper employing a trimmer blade for shearing hair, e.g., eyebrows, has been illustrated. FIGS. 1A to 1C show a basic state of a hair clipper 1, i.e., a state where a head portion 20 having a trimmer blade is not pivoted with respect to a hand-holdable portion (main body) 10. Specifically, FIGS. 1A to 1C present a front view, a side view and a cross-sectional view taken along A-A, respectively. FIG. 2 illustrates a state where the head portion 20 is pivoted with respect to the hand-holdable portion 10. FIG. 3 offers a sectional side view depicting a configuration of the hair clipper 1. FIG. 4 provides an exploded perspective view thereof. Further, in FIG. 1A, the hand-holdable portion 10 and the head portion 20 are defined as a lower part and an upper part, respectively.

As can be seen from each of the drawings, the hair clipper 1 includes the hand-holdable portion 10 to be held by a user and the head portion 20 pivotably supported with respect to the hand-holdable portion 10. A trimmer blade 30 is attached to the head portion 20 so that its cutting portion protrudes outward from the rear side.

The hand-holdable portion 10 has a cylindrical housing 11 extended in a vertical direction. The housing 11 includes a vertically elongated front member 12 having an approximately shallow U-shaped or an approximately circular arc-shaped cross section; a rear member 13, fixed to an approximately upper portion of a rear surface of the front member 12, having an approximately deeper U-shaped cross section compared to the front member 12 and a cross sectional area gradually increasing toward a lower portion thereof; and a battery cover 14 detachably attached to an approximately lower portion of the rear surface of the front member 12, having an approximately deeper U-shaped cross section compared to the front member 12 and a cross sectional area gradually decreasing toward a lower portion thereof.

As illustrated in FIGS. 1B and 3, a side cross section of the housing 11 has an approximately meniscus shape. With respect to an arrangement direction (expressed by arrow B in FIG. 1B) of the trimmer blade 30 of the head portion 20, a front side 2 and a rear side 3 are curved in an approximately arch shape, wherein the front side 2 is recessed and the rear side 3 is protruded. Further, a radius of the rear side 3 is set to be smaller than that of the front side 2, which increases a curvature thereof. Furthermore, as illustrated in FIG. 1C, a cross section of the housing 11, which is taken along line A-A, i.e., a cross section taken along a forward/backward direction of the hand-holdable portion 10, is formed in an approximately oval shape obtained by combining a plurality of approximately circular arc-shaped or approximately U-shaped curved surfaces. Such shape is based on an approximate triangle. Each side of the approximate triangle is outwardly curved and, at the same time, angled portions of each side of the approximate triangle are smoothly shaped in a circular arc. Such shape of the housing 11 enables a user to firmly grip the hand-holdable portion 10 while preventing the hand-holdable portion 10 from shifting in the user's hand when the user grips the hand-holdable portion 10 with a palm.

As depicted in FIGS. 3 and 4, a motor 15 and a part of a driving unit 40 for converting a rotation of a shaft 15A of the motor 15 into a reciprocating motion are provided in a space formed by the front member 12 and the rear member 13 inside the housing 11. Further, a battery 16 is detachably installed in a battery room formed by the front member 12 and the battery cover 14. Moreover, a switch member 17 is slidably provided on an upper portion of the front member 12.

The driving unit 40 includes a pinion gear 41 fixed to the shaft 15A of the motor 15; a face gear 43 engaged with the pinion gear 41 while pivoting with respect to a shaft 42 provided in a direction perpendicular to the shaft 15A of the motor 15; a first driving connecting piece 44 provided with an opening 44A rotatably insertion-fitted to an eccentric boss 43A provided at the face gear 43; and a second driving connecting piece 45 in which a bearing 45A provided at a lower vicinity is pivotably insertion-fitted to a shaft 44B provided at an upper vicinity of the first driving connecting piece 44. The face gear 43 has teeth formed around a peripheral portion thereof at a specific pitch while being protruded toward a rotation axis direction of the shaft 42. Further, the face gear 43 serves to change the rotation direction of the shaft 15A of the motor 15 by 90 degrees.

The head portion 20 includes a first head member 21 pivotably supported with respect to the hand-holdable portion 10 in an upper vicinity of the housing 11 of the hand-holdable portion 10; a second head member 22 fixed to a base portion of the first head member 21; and a trimmer blade cover 23 detachably attached to the first head member 21.

The trimmer blade 30 includes a plate-shaped stationary cutter 31 having a comb 31A formed in a lengthwise direction thereof; a movable cutter 32 having a comb 32A formed in a lengthwise direction thereof and moving in a reciprocating motion in a direction parallel to the stationary cutter 31; and a plate spring 33 for biasing the movable cutter 32 toward the stationary cutter 31 so that the stationary cutter 31 can be overlapped with the movable cutter 32 without having a gap therebetween. Further, the trimmer blade 30 is interchangeably installed in a space formed between the first head member 21 and the trimmer blade cover 23. Moreover, in a space formed between the first head member 21 and the second head member 22, a boss 45B provided at an upper vicinity of the second driving connecting piece 45 is fitted to an opening 32B provided at a lower vicinity of the movable cutter 32.

The second head member 22 is provided with a lock button 24 for locking the trimmer blade cover 23 to the first head member 21 by an engagement with the trimmer blade cover 23. At the same time, the lock button 24 separates the trimmer blade cover 23 from the first head member 21 by releasing the engagement with the trimmer blade cover 23. Further, provided inside the first head member 21 is a guide groove 21A for guiding a vertical reciprocating motion of the second driving connecting piece 45 while an upper vicinity 45C of the second driving connecting piece 45 is fitted to the guide groove 21A to allow for a sliding motion.

Figure 5A:
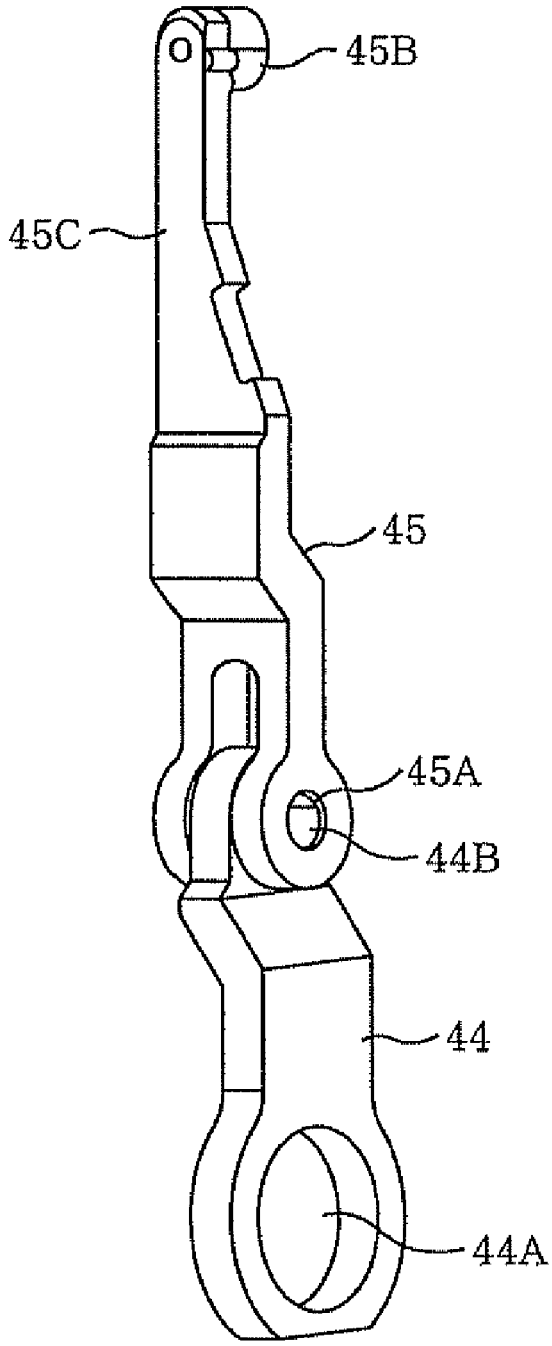
FIGS. 5A and 5B represent a perspective view showing a configuration of a driving connecting piece in the hair clipper, wherein FIGS. 5A and 5B provide states after and before a first and a second driving connecting pieces are combined, respectively.
Figure 5B:
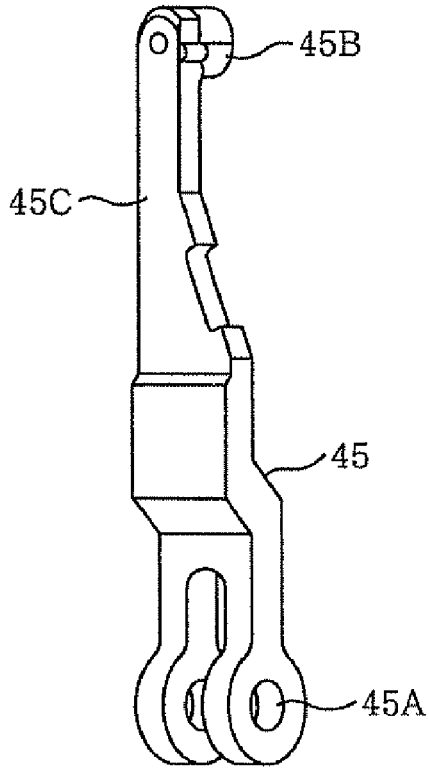
Figure 5B:
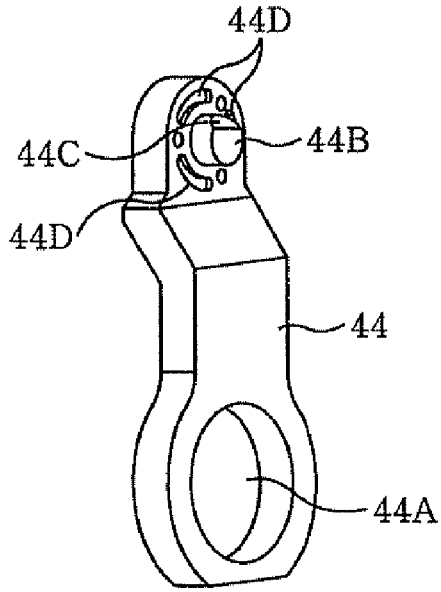

Hereinafter, the first and the second driving connecting pieces 44 and 45 will be described in detail with reference to FIGS. 5A and 5B. FIGS. 5A and 5B respectively illustrate after and before the first and the second driving connecting pieces 44 and 45 are combined. The first driving connecting piece 44 is formed by a resin forming, and the opening 44A and the shaft 44B are provided at the lower and the upper portion thereof, respectively. The second driving connecting piece 45 is also formed by a resin forming, and the bearing 45A and the boss 45B are provided at the lower and the upper portion thereof, respectively. Since each of the first and the second driving connecting pieces 44 and 45 is formed as one unit by using resin, the number of components can be reduced, thereby lowering the costs. Further, in order to facilitate an insertion-fitting between the shaft 44B and the bearing 45A of the second driving connecting piece 45, an inclined surface 44C is formed at an upper edge of the shaft 44B. Moreover, formed at a peripheral area of the shaft 44B is a recess 44D for collecting therein grease. Accordingly, it is possible to stably supply grease to an insertion-fitting portion between the shaft 44B of the first driving connecting piece 44 and the bearing 45A of the second driving connecting piece 45.

The opening 44A of the first driving connecting piece 44 is insertion-fitted to the eccentric boss 43A of the face gear 43, and a center thereof revolves along a track drawn by a center of the eccentric boss 43A. Meanwhile, the upper vicinity 45C of the second driving connecting piece 45 is guided by the guide groove 21A of the first head member 21 and, therefore, the second driving connecting piece 45 vertically moves in a reciprocating motion. Since this embodiment has two driving connecting pieces composed of the first and the second driving connecting pieces 44 and 45, the second driving connecting piece 45 for driving the movable cutter 32 of the trimmer blade 30 inside the head portion 20 only moves in a reciprocating motion without pivoting in a horizontal direction. As a results an inner space of the head portion 20 can be reduced, thereby allowing the entire size of the head portion 20 to become small and lightweight.

Figure 6:
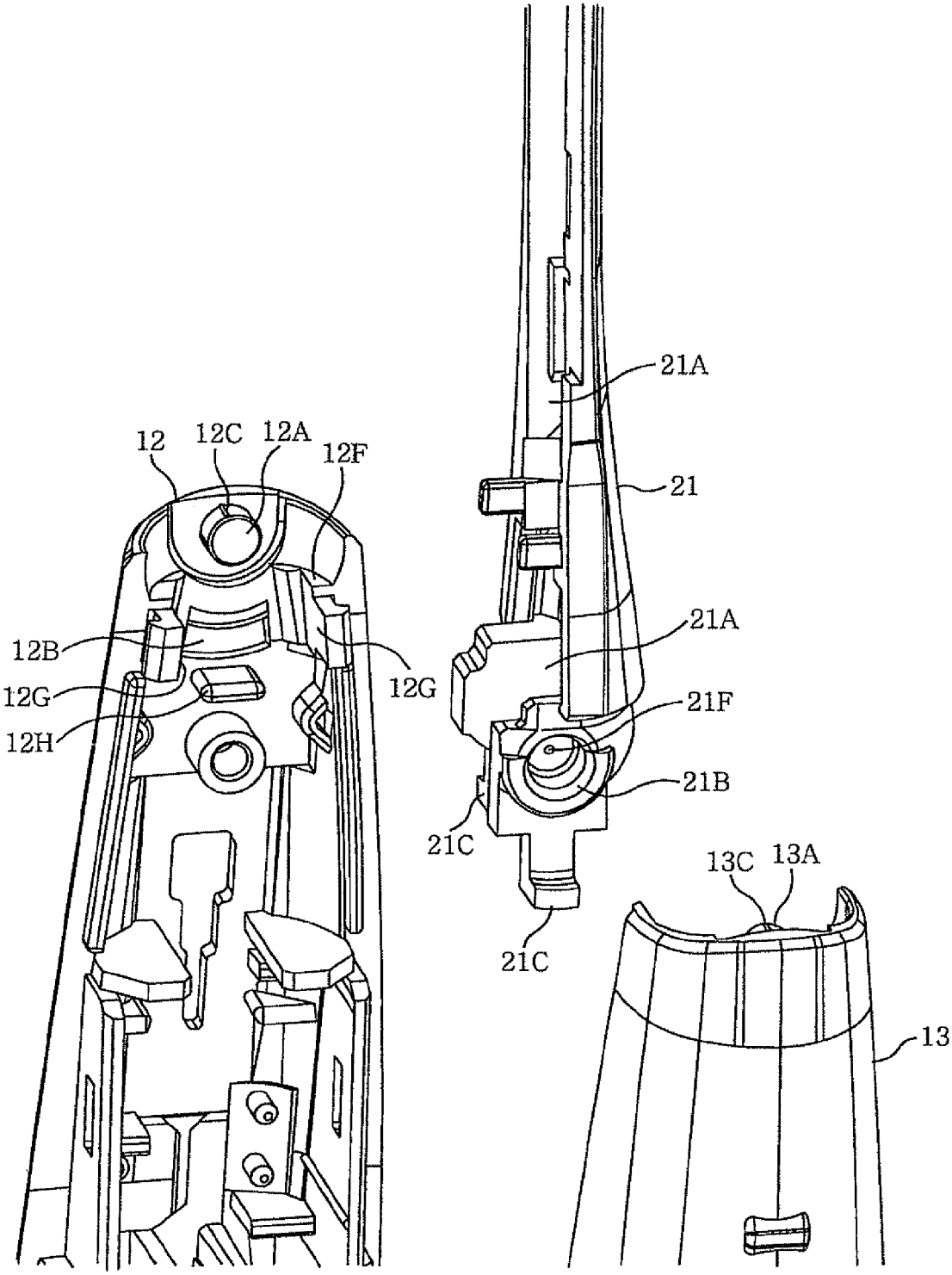
FIG. 6 offers a perspective view illustrating a configuration of a pivoting device in which the head portion pivots with respect to the hand-holdable portion in the hair clipper.

Hereinafter, a pivoting device in which the head portion 20 pivots with respect to the hand-holdable portion 10 will be described in detail. As shown in FIG. 6, support members 12A and 13A for pivotably supporting the first head member 21 of the head portion 20 are respectively provided on inner peripheral surfaces of upper vicinities of the front member 12 and the rear member 13, the front member 12 and the rear member 13 configuring the housing 11 of the hand-holdable portion 10. Meanwhile, bearing portions 21B insertion-fitted to the support members 12A and 13A are provided at a lower vicinity of the first head member 21. Further, protrusions 21C for restricting a pivotable range of the first head member 21 are so formed at a lowest portion of the first head member 21 as to be protruded toward the front member 12 and the rear member 13, respectively. Meanwhile, provided in inner peripheral portions of the front member 12 and the rear member 13 are the protrusions 21C and guide grooves 12B and 13B, respectively (see FIGS. 9A and 9B), wherein the guide grooves 12B and 13B serve to restrict pivoting of the first head member 21 by contacting with the protrusions 21C when the protrusions 21C pivot at a specific angle. In addition, the head portion 20 pivots with respect to the hand-holdable portion 10 on a surface perpendicular to a protruding direction of the teeth of the trimmer blade 30.

As described in FIG. 6, a plurality of linear protrusions 12C and 13C are provided around outer peripheral surfaces of the support members 12A and 13A in a direction parallel to a central axis of the support members 12A and 13A. Further, provided on a central bottom surface of the bearing portion 21B is an approximately hemispheric or approximately cylindrical protrusion 21F protruding in a direction parallel to the support members 12A and 13A. With such configuration, it is possible to reduce sliding friction and abrasion between the support members 12A and 13A and the bearing portion 21B, which are generated when the head portion 20 pivots with respect to the hand-holdable portion 10.

As illustrated in FIGS. 1A and 2, a length of the head portion 20 in a vertical direction corresponds to ⅕ to ⅓ of an entire length of the hair clipper 1. Further, upper portions of the front member 12 and the rear member 13 are formed so as to make it highest in central portions thereof and shorter toward both side portions. Accordingly, although the head portion 20 pivots with respect to the hand-holdable portion 10 to a maximum angle, a specific gap 4 is formed between both lower portions of the first head member 21 and both upper portions of the front member 12 and the rear member 13. Thus, when a user uses the hair clipper 1, it is possible to recognize where the head portion 20 pivots and where to grip. Further, when the user grips the hand-holdable portion 10, there is not much possibility of a user's hand reaching into a gap portion between the upper portion of the hand-holdable portion 10 and the lower portion of the head portion 20, thereby reducing a possibility in which the user's hand obstructs the head portion 20 from pivoting. As a result, the conformability of the head portion 20, specifically, the trimmer blade 30 to the irregularities of the skin becomes enhanced, thereby making it more convenient to use. Furthermore, even if the user's hand reaches into the gap between the upper portion of the hand-holdable portion 10 and the lower portion of the head portion 20, fingers or the like can be prevented from being pinched between the hand-holdable portion 10 and the head portion 20, thereby making the design safe.

Figure 7:
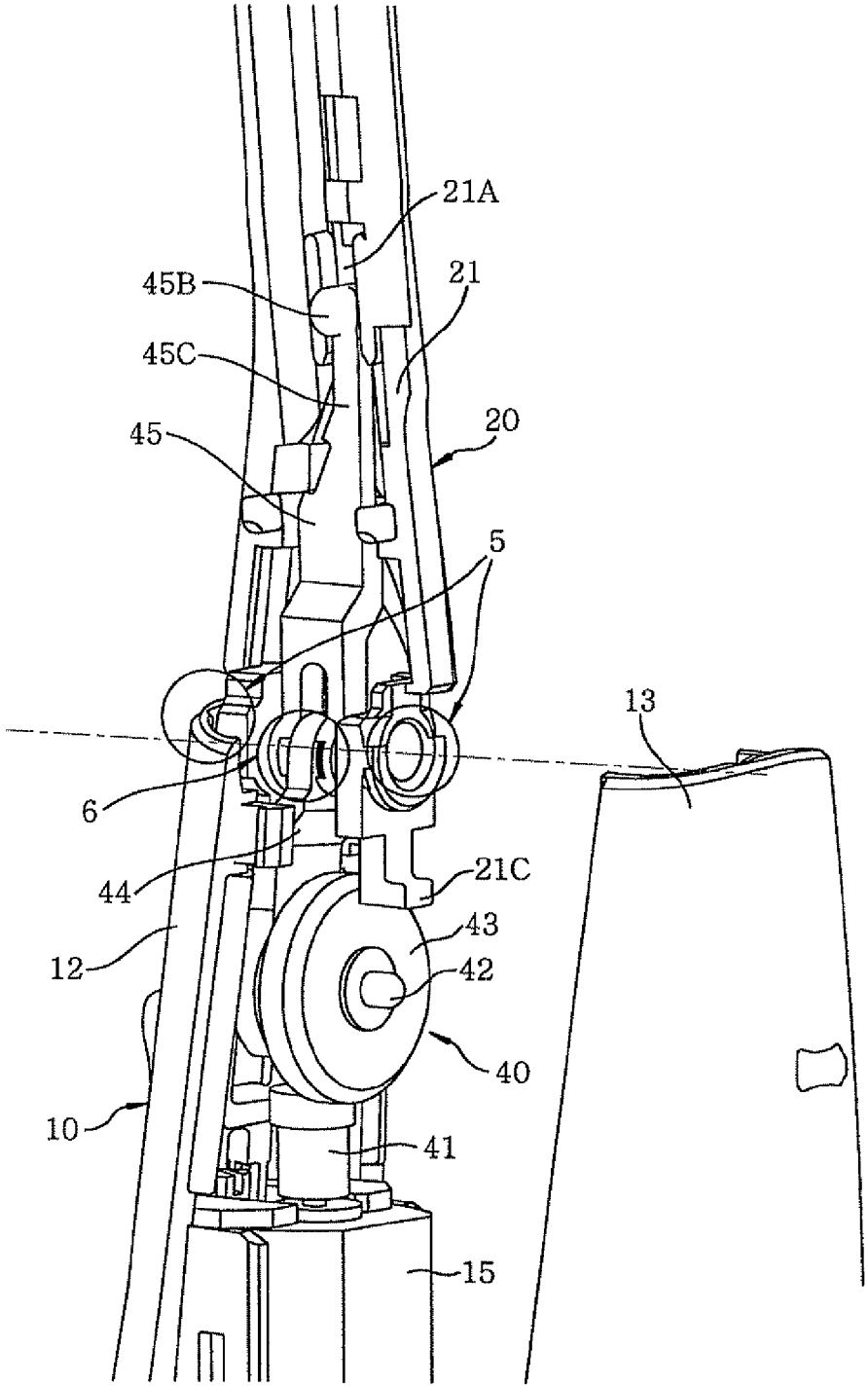
FIG. 7 shows a perspective view depicting a relative layout between a driving unit and the pivoting device of the head portion in the hair clipper.

Hereinafter, a relationship between the driving unit 40 and the pivoting device of the head portion 20 will be described. As illustrated in FIGS. 4 and 6, the guide groove 21A of the first head member 21 elongates to a portion positioned between two bearing portions 21B provided at the lower vicinity of the first head member 21. As depicted in FIG. 7, a connecting portion of the first and the second driving connecting pieces 44 and 45 is positioned between the bearing portions 21B. In other words, a point where the head portion 20 pivots with respect to the hand-holdable portion 10 and that where the second driving connecting piece 45 pivots with respect to the first driving connecting piece 44 are approximately coaxial. With such configuration, the second driving connecting piece 45 moves only in a reciprocating motion at a portion positioned above the bearing portions 21B, i.e., a pivoting point of the head portion 20. Accordingly, it is possible to make an entire head portion 20 slim or small.

Figure 8:
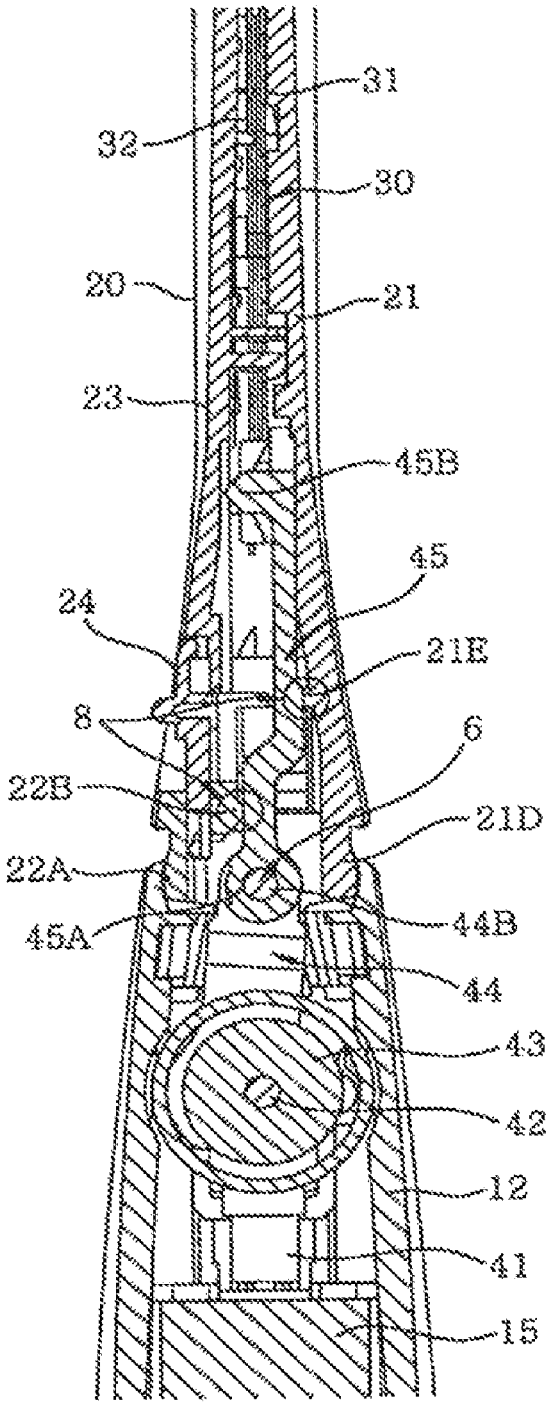
FIG. 8 provides a sectional side view describing a configuration of principal components of the driving unit in the hair clipper.

As shown in FIG. 8, a bottom portion 21D of the first head member 21 and a bottom portion 22A of the second head member 22 are protruded outward in both directions, respectively, so that they form a part of spherical surface. In the meantime, inner peripheral surfaces of the upper vicinities of the front member 12 and the rear member 13 (not shown) are outwardly recessed in both directions, respectively. Accordingly, the head portion 20 can pivot with respect to the hand-holdable portion 10 while being supported by a spherical shaped bearing configuration.

As illustrated in FIG. 8, provided at the first and the second head members 21 and 22 are guide protrusions 21E and 22B for guiding a reciprocating motion of the second driving connecting piece 45 in a direction (both directions in FIG. 8) perpendicular to a bottom surface of the guide groove 21A. A guide portion 8 having the guide groove 21A and the guide protrusions 21E and 21B is provided at the point 6 where the second driving connecting piece 45 pivots with respect to the first driving connecting piece 44. Accordingly, when the second driving connecting piece 45 moves in a reciprocating motion, it is possible to reduce the swinging range in the direction perpendicular to the reciprocating motion, thereby reducing a swinging loss while operating the device.

Figure 9A:
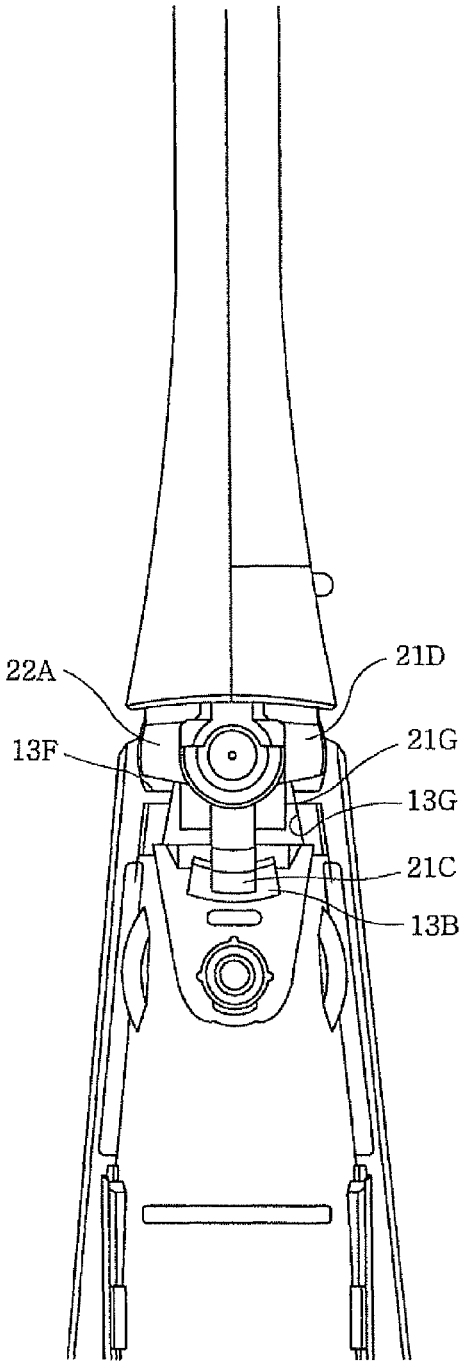
Figure 9B:
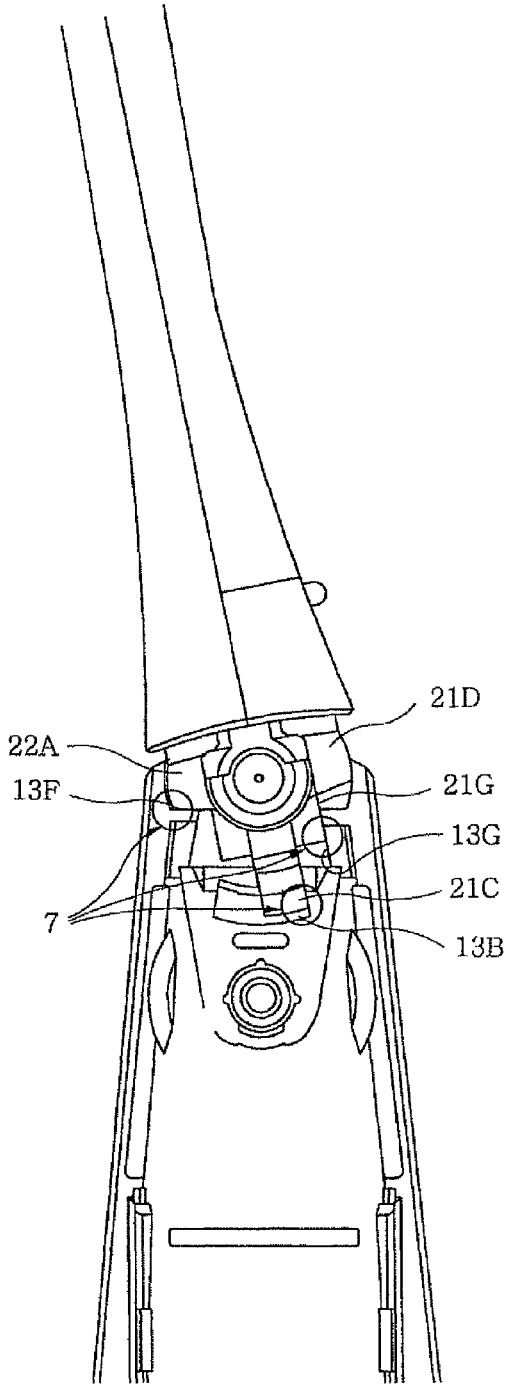

FIGS. 9A and 9B illustrate a mechanism for restricting a pivotable range of the head portion 20 with respect to the hand-holdable portion 10. FIGS. 9A and 9B provide a basic state where the head portion 20 is not pivoted and a state where the head portion 20 is pivoted to a maximum angle. Further, FIGS. 9A and 9B show an inner portion of the assembled hair clipper 1, which is seen through from the rear member 13.

In the state shown in FIG. 9B, the protrusion 21C provided at the lowest portion of the first head member 21 contacts with an end surface of the guide groove 13B of the rear member 13, thereby restricting further pivoting of the head portion 20 beyond the end surface thereof. Further, a flange portion 13F of the upper vicinity of the rear member 13 contacts with a bottom surface of the bottom portion 21D of the first head member 21 or that of the bottom portion 22A of the second head member 22, the bottom portions 21D and 22A forming the spherical shaped bearing structure. Furthermore, a side surface 21G of the lower vicinity of the first head member 21 contacts with an end surface 13G of the rear member 13. Although it is not illustrated, the above-described contact structure is equally applied to the front member 12. Likewise, the first and the second head members 21 and 22 forming the head portion 20 contacts a plurality of portions of the front and the rear members 12 and 13 forming the hand-holdable portion 10. Further, a plurality of stopper mechanisms are provided thereat, thereby enabling to distribute a load applied to the head portion 20. As a result, even if an excessive load is applied during the pivoting of the head portion 20, it is possible to reduce a possibility of damaging the front member 12, the rear member 13, the first head member 21 and the second head member 22. Moreover, by distributing a load to the plurality of stopper mechanisms 7, strength of the stopper mechanism 7 can be reduced and, further, an entire size of the hair clipper 1 can be scaled down.

Figure 10A:
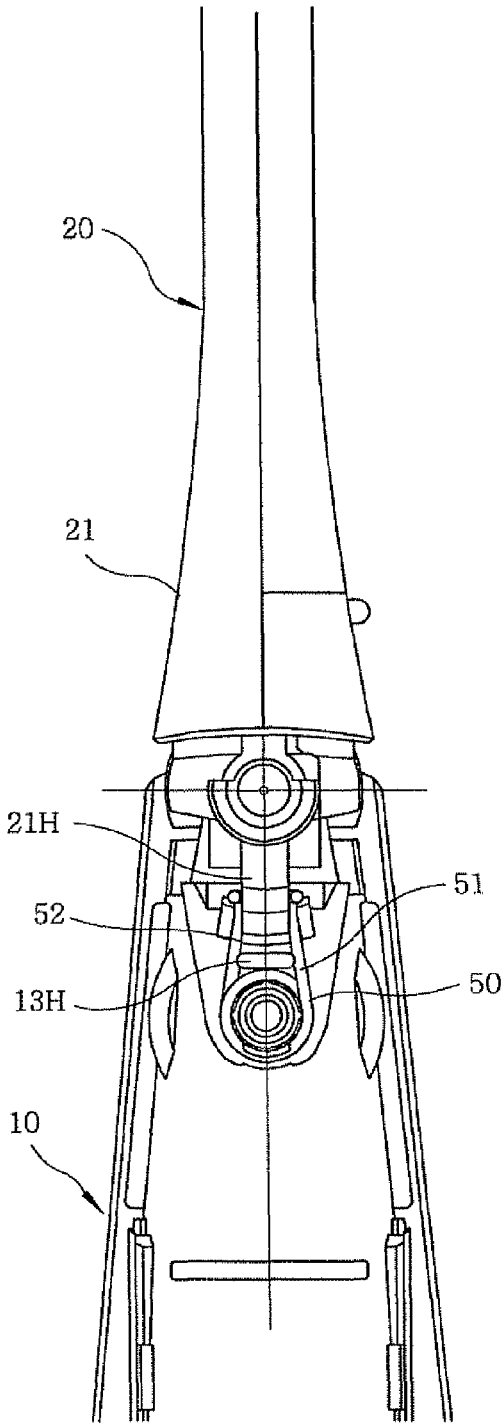
FIGS. 10A and 10B describe a mechanism for applying a restoring force to the head portion pivoting with respect to the hand-holdable portion in the hair clipper, wherein the FIGS. 10A and 10B provide a basic state where the head portion is not pivoted and a state where the head portion is pivoted to its maximum allowable angle, respectively.
Figure 10B:
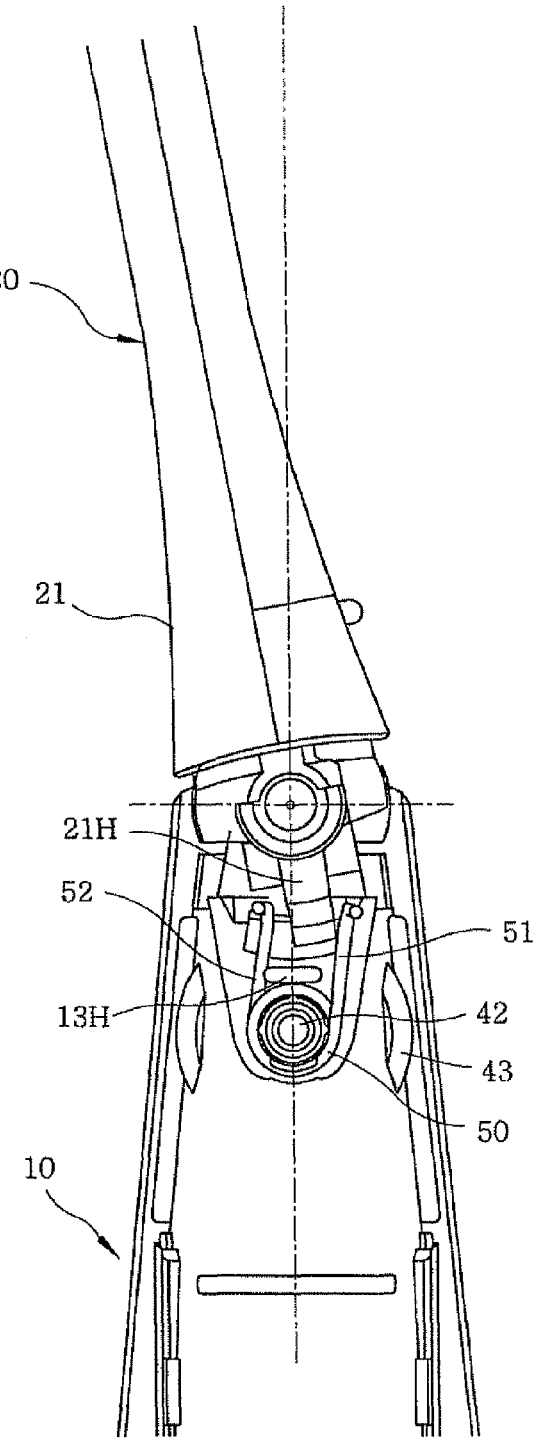

Next, FIGS. 10A and 10B depict a mechanism for applying a restoring force to the head portion 20 pivoting with respect to the hand-holdable portion 10. FIGS. 10A and 10B represent a basic state where the head portion 20 is not pivoted and a state where the head portion 20 is pivoted to a maximum angle, respectively. Further, as in FIGS. 9A and 9B, FIGS. 10A and 10B show an inner portion of the assembled hair clipper 1, which is seen through from the rear member 13.

In the basic state shown in FIG. 10A, a torsion coil spring 50 is coaxially provided with the shaft 42 of the face gear 43 and, further, installed in a way that two arms 51 and 52 thereof hold therebetween the lower portion 21H of the first head member 21 at both sides. Further, the front member 12 and the rear member 13 are provided with stoppers 12H (see FIG. 6) and 13H for restricting a rotation of the arms 51 and 52, respectively. Furthermore, if the head portion 20 pivots with respect to the hand-holdable portion 10, the lower portion 21H of the first head member 21 outwardly pushes the arm 51, as illustrated in FIG. 10B. At this time, since a movement of the other arm 52 is restricted by the stoppers 12H and 13H, the arm 51 becomes extended outwardly and, thus, the torsion coil spring 50 becomes transformed elastically. Accordingly, a restoring force for rotating the lower portion 21H of the first head member 21 in the direction opposite to the pivoting direction of the first head member 21 is charged to the torsion coil spring 50. The opposite case is the same. As a result, when hair is trimmed with the trimmer blade 30 of the head portion 20 close to the skin, the conformability of the trimmer blade 30 to irregularities of the skin can be improved by the restoring force of the torsion coil spring 50.

Figure 11A:
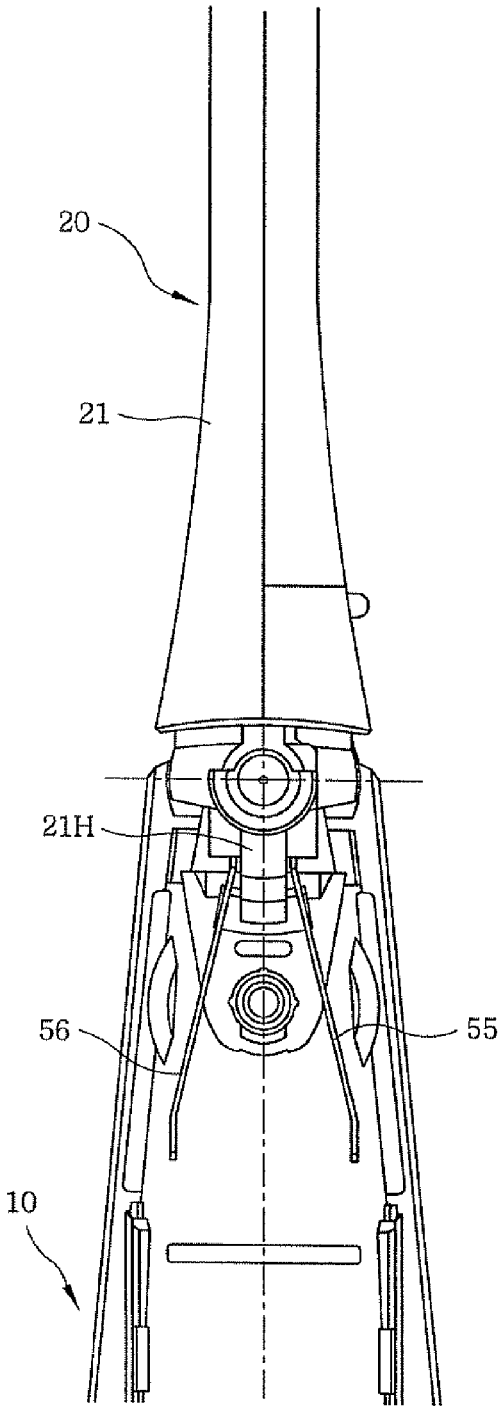
FIGS. 11A and 11B illustrate another mechanism for applying a restoring force to the head portion pivoting with respect to the hand-holdable portion in the hair clipper, wherein the FIGS. 10A and 10B represent a basic state where the head portion is not pivoted and a state where the head portion is pivoted to its maximum allowable angle, respectively.
Figure 11B:
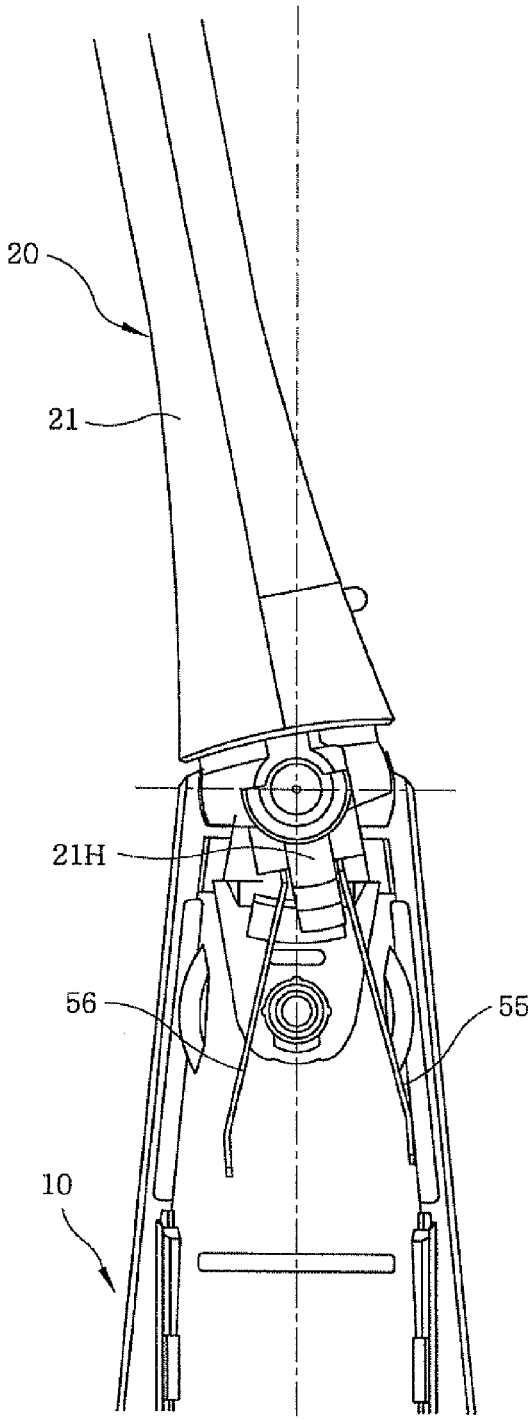

FIGS. 11A and 11B represent a modified example using plate springs 55 and 56 instead of the torsion coil spring 50. The plate springs 55 and 56 are provided at the lower portion 21H of the first head member 21. When the head portion 20 pivots, the plate springs 55 and 56 contacts the stoppers 12H and 13H or inner peripheral surfaces of the front and the rear member 12 and 13. Accordingly, the plate springs 55 and 56 become transformed elastically, thereby charging a restoring force thereto. Such configuration can also provide the same effects obtained by using the torsion coil spring 50.

Figure 12A:
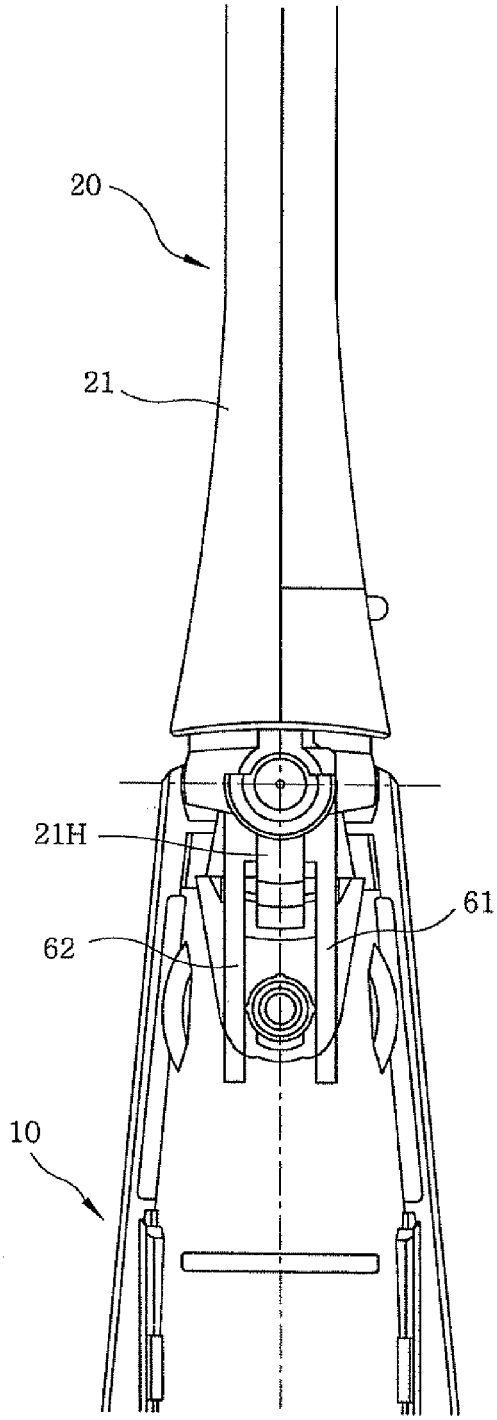
FIGS. 12A and 12B provide still another mechanism for applying a restoring force to the head portion pivoting with respect to the hand-holdable portion in the hair clipper, wherein the FIGS. 10A and 10B present a basic state where the head portion is not pivoted and a state where the head portion is pivoted to its maximum allowable angle, respectively.
Figure 12B:
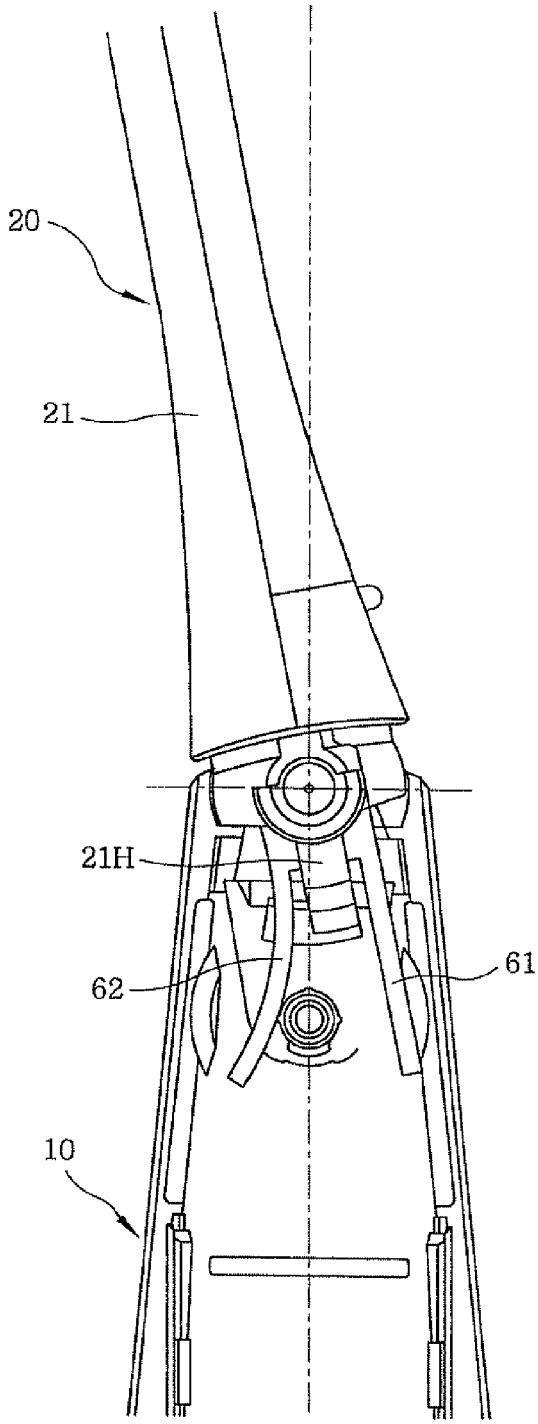
Figure 13:
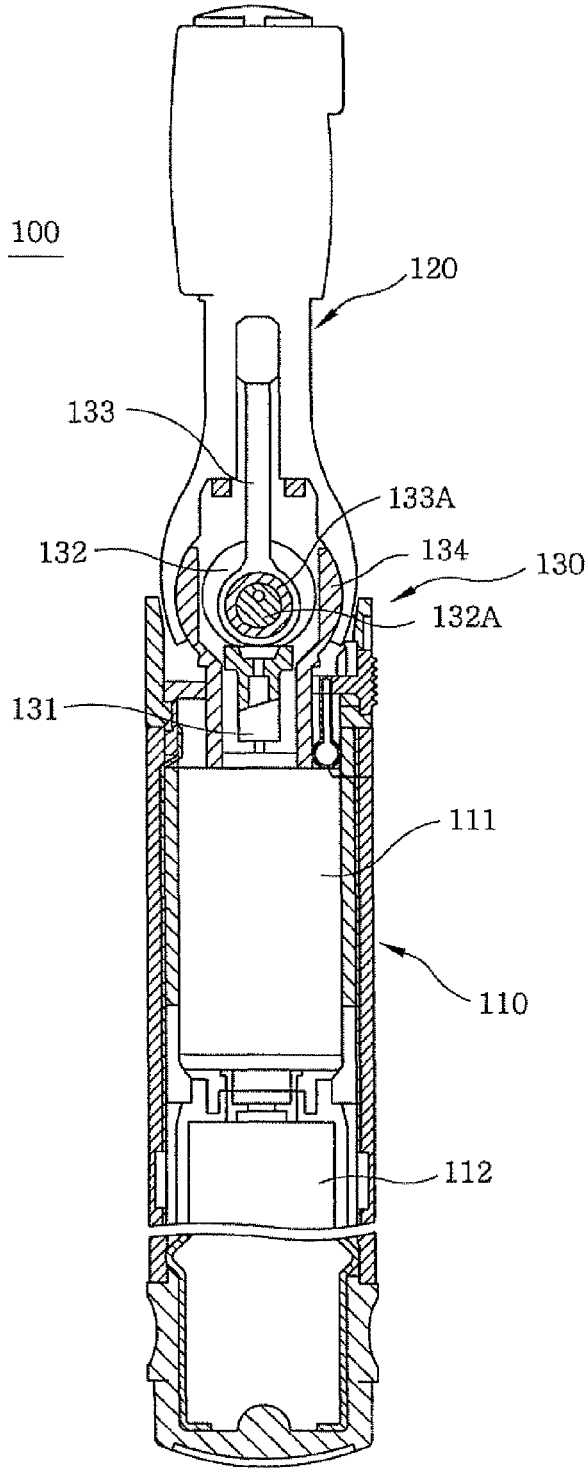
FIG. 13 (PRIOR ART)
FIG. 13 offers a cross-sectional view showing a conventional hair clipper.

FIGS. 12A and 12B depict a modified example using arm portions 61 and 62 formed as one unit at the lower portion 21H of the first head member 21 instead of the torsion coil spring 50 or the plate springs 55 and 56, the arm portions 61 and 62 being made of resin and serving as plate springs. As in case of the plate springs 55 and 56, when the head portion 20 pivots, the arm portions 61 and 62 contact the stoppers 12H and 13H or the inner peripheral surfaces of the front and the rear members 12 and 13. Accordingly, the arms portions 61 and 62 become elastically transformed, thereby charging a restoring force thereto. Such configuration can also provide the same effects obtained by using the torsion coil spring 50.

Although the aforementioned embodiments have described a hair clipper as an example, the present invention can be applied to a personal trimming system, in which a head portion provided with a driven member reciprocating can pivot with respect to a main body, such as an electric shaver or an electric brush without being limited to the aforementioned example.

While the invention has been shown and described with respect to the preferred embodiments, it will be understood by those skilled in the art that various changes and modification may be made without departing from the spirit and scope of the invention as defined in the following claims.

What is claimed is:

1. A personal trimming system for trimming hair from a body surface, comprising:

an elongated main body having a motor and a part of a driving unit for converting a rotation of the motor into a reciprocating motion, the elongated main body having a lengthwise dimension that defines a length direction of the trimming system; and an elongated head portion extending from an end of said main body generally along said length direction, the head portion having a driven member reciprocating generally along said length direction, wherein the head portion is pivotably supported with respect to the main body, and a gap is provided between the main body and a step formed on a boundary between an upper portion of the head portion and a lower portion of the head portion, wherein a restriction unit for restricting pivoting of the head portion is provided in the main body, and wherein the restriction unit includes a torsion coil spring installed in a way that two arms thereof hold therebetween the lower portion of the head portion.

2. The personal trimming system of claim 1, wherein a length of the head portion is about ⅕ to ⅓ of an entire length of the personal trimming system.

3. The personal trimming system of claim 1, wherein the gap is small enough to prevent a user's skin from being pinched therebetween in a state where the head portion is pivoted to a maximum allowable angle with respect to the main body.

4. The personal trimming system of claim 1, wherein the head portion is pivoted on the main body via the lower portion of the head portion, and a part of the lower portion of the head portion is exposed outward and a circumference thereof is smaller than those of the upper portion of the head portion and the main body.

5. The personal trimming system of claim 1, wherein the head portion has a cutting blade and the direction of the pivoting axis of the head portion is substantially parallel to a plane defined by the cutting blade.

* * * * *